US006139252A

United States Patent [19]

Honegger

[11] Patent Number: 6,139,252

[45] Date of Patent: Oct. 31, 2000

[54] METHOD AND APPARATUS FOR PROCESSING FLAT PRINTED PRODUCTS, SUCH AS NEWSPAPERS, MAGAZINES AND PARTS THEREOF

[75] Inventor: Werner Honegger, Bach, Switzerland

[73] Assignee: Ferag AG, Hinwil, Switzerland

[21] Appl. No.: 09/008,395

[22] Filed: Jan. 16, 1998

[30] Foreign Application Priority Data

Jan. 16, 1997 [CH] Switzerland ..... 0076/97

[51] Int. Cl.[7] ..... B65G 57/32

[52] U.S. Cl. ..... 414/791.2; 198/374; 198/377.07

[58] Field of Search ..... 198/374, 377.01, 198/377.07, 377.1; 414/792.7, 791.2, 801

[56] References Cited

U.S. PATENT DOCUMENTS

| | | | |
|---|---|---|---|
| 3,809,214 | 5/1974 | Reist . | |
| 3,837,474 | 9/1974 | Brooke | 198/374 |
| 3,955,667 | 5/1976 | Mulller et al. . | |
| 4,155,133 | 5/1979 | Timson | 198/374 |
| 4,307,800 | 12/1981 | Joa | 198/374 |
| 4,330,288 | 5/1982 | Russell et al. | 198/377.07 |
| 4,483,526 | 11/1984 | Bulka et al. | 198/377.07 |
| 5,261,520 | 11/1993 | Duke . | |
| 5,388,820 | 2/1995 | Eberle et al. . | |
| 5,395,151 | 3/1995 | Eberle . | |

FOREIGN PATENT DOCUMENTS 966402 8/1964 United Kingdom .

*Primary Examiner*—Gregory A. Morse
*Attorney, Agent, or Firm*—Brinks Hofer Gilson & Lione

[57] ABSTRACT

Specific printed products (2') of the printed products (2, 2') that are conveyed one behind another in a hanging position are rotated through 180° about an axis of rotation that runs at right angles to the main surface (6) of these printed products (2'). Following the rotation, the rotated printed products (2") are gripped once more at their side edge (7) located at the top, which is opposite the side edge (4) at which the printed products (2') were held before the rotation. In this way, a product stream is obtained in which specific printed products (2") assume a spatial position different from that of the remaining printed products (2). For example, in this product stream the folded edge (4) of the nonrotated printed products (2) lies at the top, whereas the folded edges (4) of the rotated printed products (2") lie at the bottom. This results in advantages in the later further processing of the printed products (2, 2"), for example during stacking.

18 Claims, 8 Drawing Sheets

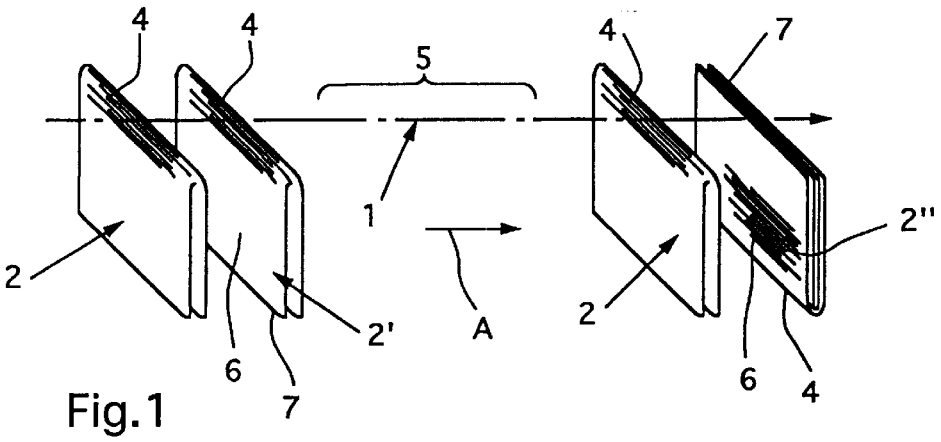
Fig.1
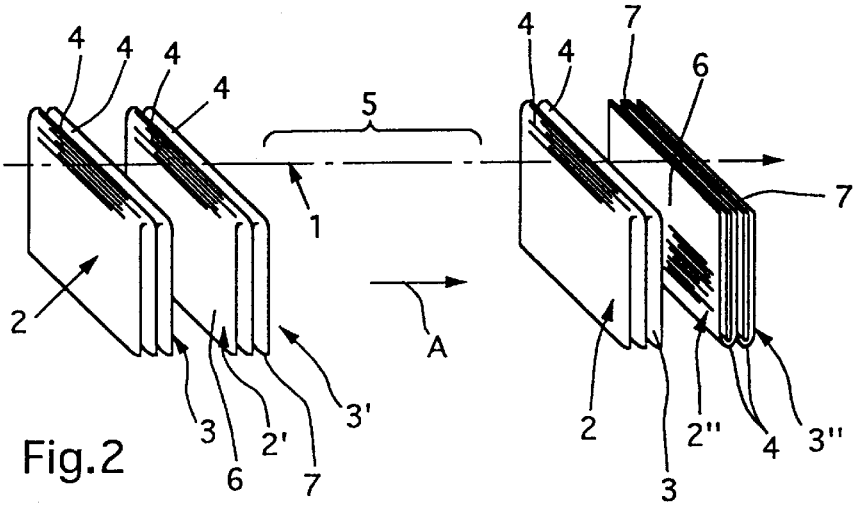
Fig.2
Fig.3
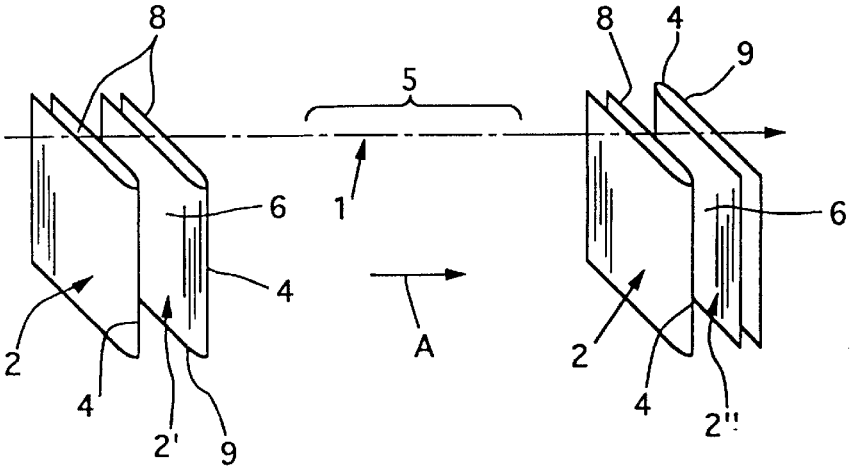

METHOD AND APPARATUS FOR PROCESSING FLAT PRINTED PRODUCTS, SUCH AS NEWSPAPERS, MAGAZINES AND PARTS THEREOF

BACKGROUND OF THE INVENTION

The present invention relates to a method and an apparatus for processing flat printed products, such as newspapers, magazines and parts thereof. The invention includes the method for processing flat printed products, such as newspapers, magazines and parts thereof, in which the printed products are held in the region of a side edge by controllable grippers, which are moved along a conveying path. The printed products are conveyed by these grippers in a product stream. The invention also includes an apparatus for processing flat printed products, such as newspapers, magazines and parts thereof, having a conveying device for conveying the printed products in a product stream along a conveying path. The conveying device has controllable grippers, arranged one behind another at intervals along the conveying direction, that function to grip the printed products in the region of a first side edge.

Conveying devices for conveying printed products, which devices have grippers arranged one behind another at intervals, are known for example in European Applications EP-A-0 557 680 and EP-A-0 600 183 and the corresponding U.S. Pat. Nos. 5,388,820 and 5,395,151 respectfully. The grippers of these known conveying devices grip the printed products in the region of one of their side edges and hold the printed products firmly at this side edge during the entire conveying travel, that is to say until the printed products are delivered.

In Swiss Patent Application, CH-A-546 197 and the corresponding U.S. Pat. No. 3,809,214, various embodiments of turning conveyors with drivers are described, which take over the printed products, conveyed by a belt conveyor in a horizontal imbricated formation, from this belt conveyor. The drivers of the turning conveyors act on the printed products and rotate the latter during their further conveyance through 90° about a vertical axis of rotation running at right angles to the main surface of the printed products. In this way, for example, the folded edge of the printed products that leads in the imbricated formation becomes the side edge in the following imbricated formation. After the printed products have been rotated, they are once more conveyed further in a horizontal imbricated formation by a further belt conveyor.

SUMMARY OF THE INVENTION

The present invention is, based on the object of providing a method and an apparatus of the type mentioned above which allows a product stream to be formed from the printed products supplied, in which product stream certain printed products assume a position that is different from the remaining printed products.

According to the invention, this object is achieved by a method in which the flat printed products, such as newspapers, magazines and parts thereof are held in the region of a first side edge by controllable grippers, which are moved along a conveying path along a product stream, and wherein at least some of the printed products are rotated through at least 90° about an axis of rotation situated at right angles to their surface. The printed products are released by their original grippers and following the rotation are gripped in the region of a second side edge by second grippers for further transport.

By rotating certain products of the product stream about an axis of rotation running at right angles to the main surface of these printed products along the conveying path, the position of these printed products is changed, so that the side edges of the rotated printed products in the product stream come to lie otherwise than before the rotation.

This invention also includes apparatus for processing flat printed products, such as newspapers, magazines and parts thereof, having a basic conveying device for conveying the printed products in a product stream along a conveying path. The basic conveying device has controllable grippers, arranged one behind another at intervals in the conveying direction, to grip the printed products in the region of a first side edge. There is arranged below the conveying device a transporting and rotating apparatus which grips at least some of the printed products conveyed by the basic conveying device in the region of a second side edge, which runs parallel or at right angles to the first side edge and transports the gripped printed products in a direction of motion that runs in the conveying direction of the basic conveying device. The transporting and rotating apparatus on its own or in co-operation with the basic conveying device, rotates the printed products through at least 90° about an axis of rotation running at right angles to their main surface.

BRIEF DESCRIPTION OF THE DRAWINGS

Exemplary embodiments of the subject of the invention are explained in more detail in the following text with reference to the drawing, in which, the apparatus is shown schematically:

FIGS. 1–3 show various possibilities for rotating specific printed products along their conveying path.

DETAILED DESCRIPTION OF THE PREFERRED EMBODIMENT

Figure 4:
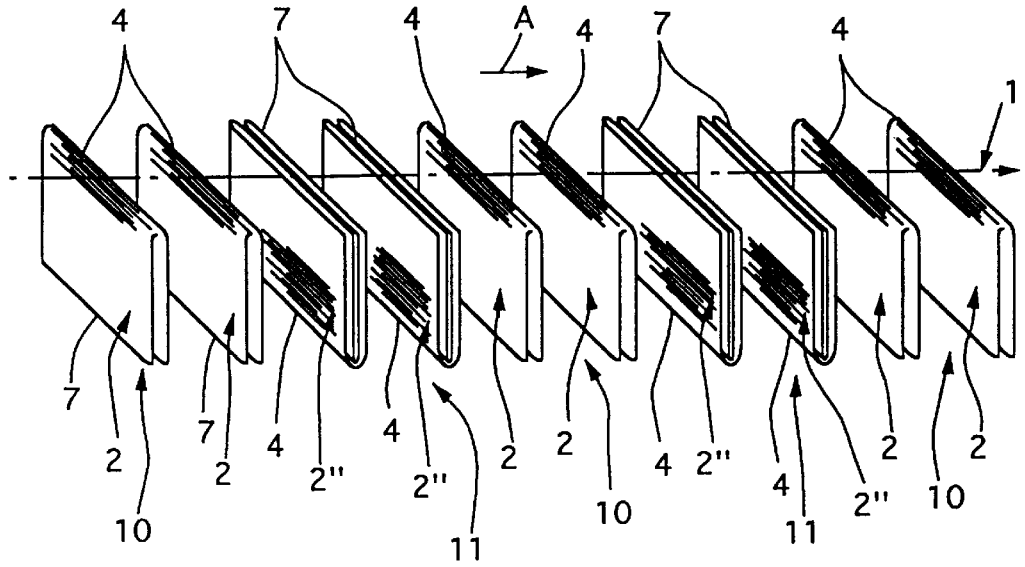
FIG. 4 shows a section of a product stream with printed products rotated section by section.

The simplified illustrations of FIGS. 1–3, through which the principle according to the invention will be explained, show various possibilities for rotating specific printed products during the conveying operation. Shown purely schematically in these FIGS. 1–3 is a conveying device 1 which has controllable grippers (not illustrated) for the firm holding of printed products 2, 2', 2" (FIGS. 1 and 3) and 2, 3, 2', 3', 2", 3" (FIG. 2). The conveying direction of the conveying device 1 is designated by arrow A.

In the case of the embodiment according to FIG. 1, all the printed products conveyed are gripped by the grippers (not shown) in the region of the side edge designated by 4, which, by way of example, is the folded edge in all the following exemplary embodiments. In a rotating region, which is designated by 5 and not illustrated in detail, specific printed products 2', for example every second printed product, are rotated in a manner still to be described. To be specific products 2' are rotated through 180° about an axis of rotation situated at right angles to the main surface 6 of these printed products 2'. If the printed products 2' are conveyed hanging approximately vertically and running approximately at right angles to the conveying direction A, then this axis of rotation is directed approximately parallel to the conveying direction A. For this rotation operation, the printed products 2' to be rotated are released by the associated gripper of the conveying device 1 and, as will be explained further, temporarily gripped by other means. After the rotation, the side edges 4 gripped by the grippers before the rotation are now located at the bottom, and the rotated printed products 2" are gripped once more in the region of the opposite side edge 7, be it by the same gripper or another gripper of the conveying device 1 or by a gripper of a further conveying device.

The variant shown in FIG. 2 differs from the exemplary embodiment according to FIG. 1 in the fact that each gripper grips two products 2 and 3 or 2', 3' in the region of the side edge 4. Specific bundles of two printed products 2', 3' are rotated as described in the above reference to FIG. 1. The rotated printed products 2" and 3" are then held in the region of the side edge 7.

The embodiment according to FIG. 3 corresponds to the embodiment according to FIG. 1, with the difference that in the illustration according to FIG. 3 the printed products are not gripped in the region of the side edge (folded edge) 4, but in the region of an open side edge 8 running at right angles to the side edge 4. Following the rotation, the rotated printed product 2" is gripped at the open side edge 9 located opposite the side edge 8.

It goes without saying that the printed products can also be brought up by the conveying device 1 in other spatial positions. It is also possible that the printed products in the incoming product stream do not all assume the same spatial position. Furthermore, it is also conceivable to rotate the printed products 2' only through 90° instead of through 180° as shown.

Illustrated in FIG. 4 is a section of a product stream after the rotation of specific printed products has been performed, the same reference symbols being used as in FIG. 1. In this product stream, sections 10 with nonrotated printed products 2 alternate with sections 11 with printed products 2" rotated through 180°. In the case of the embodiment according to FIG. 4, each section 10 and 11, respectively, consists of two printed products 2 and 2", respectively. Of course, it is also possible to form sections with another or a different number of printed products 2 and 2".

Figure 5:
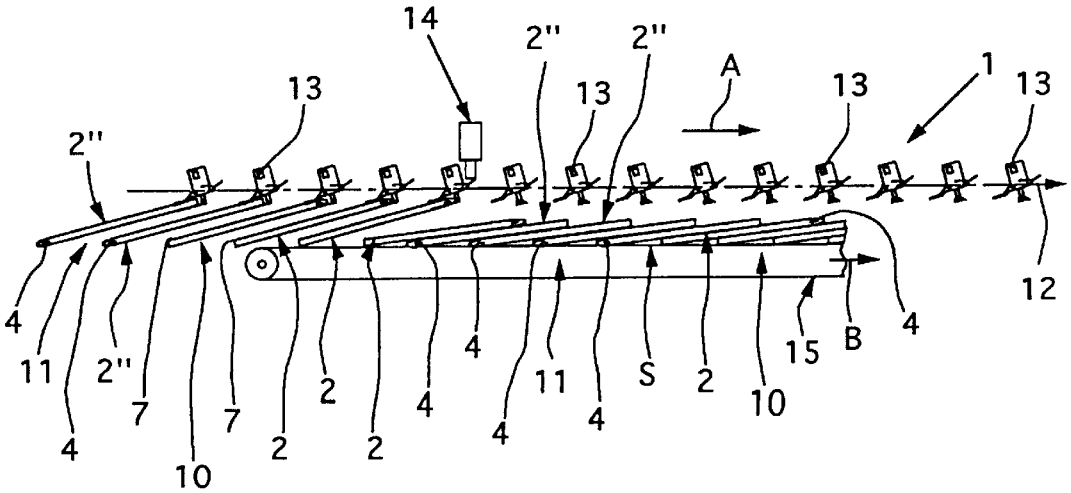
FIG. 5 shows a section of another product stream with printed products rotated section by section.

Illustrated in FIG. 5, in a manner similar to that in FIG. 4, is a section of a product stream after the rotation of specific printed products has been performed. In the case of this embodiment, the conveying device 1 corresponds to the transporter illustrated in DE-A-25 19 561 and the corresponding U.S. Pat. No 3,955,667. The conveying device 1 has controllable grippers 13 arranged at regular intervals on a conveying means 12, for example a chain. These grippers 13 are directed to the rear, as seen in the conveying direction A, and hold the printed products 2, 2" in the region of their leading side edge 4 or 7, respectively, located at the top in the product stream. As best seen in FIG. 5, in this case the printed products 2, 2" assume a hanging position, however they do not hang vertically as shown in FIGS. 1–4, but assume a position falling obliquely to the rear. Just as in FIG. 4, in FIG. 5 the sections comprising nonrotated printed products 2 are designated by 10 and the sections comprising rotated printed products 2" are designated by 11. The individual sections 10, 11 in this case comprise four printed products 2 and 2" in each case. In order to open the grippers 13 for the purpose of delivering the printed products 2, 2", there is arranged in the movement path of the grippers 13 a triggering apparatus 14, which has the effect that the grippers passing by open. The printed products 2, 2" that are released in this process are deposited on a belt conveyor 15 arranged underneath the conveying device 1 and are conveyed further by said conveyor in the direction of the arrow B in an imbricated formation S. In this imbricated formation S, each respective printed product 2, 2" rests on the preceding printed product. The leading side edge, located at the top, in this imbricated formation S is formed by the edge 4 in the case of the printed products 2 of the sections 10 and by the side edge 7 in the case of the printed products 2" of the sections 11.

A first embodiment of a device for rotating specific printed products will now be explained with reference to FIGS. 6–8.

Figure 6:
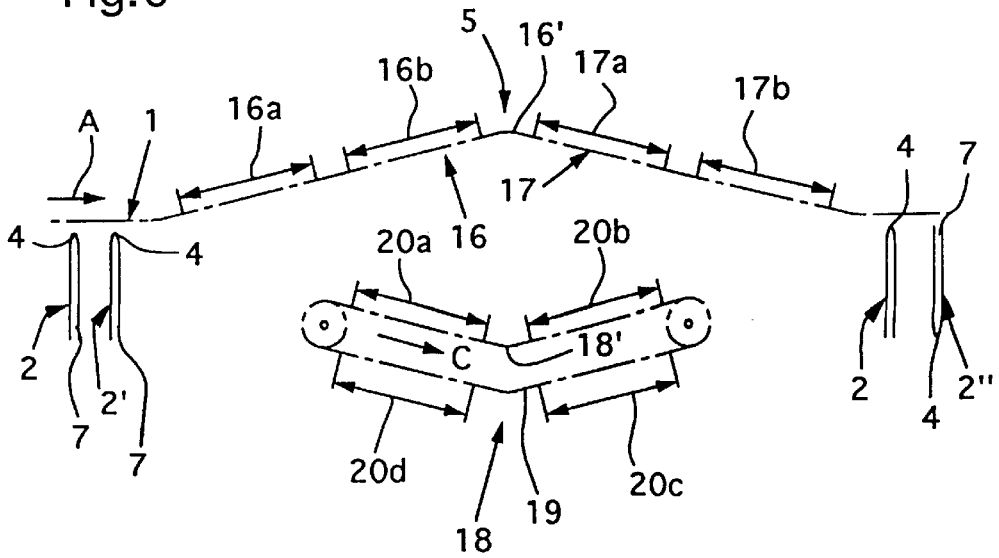

FIG. 6 shows only entirely schematically the arrangement of the conveying device 1 in the rotation region 5, as well as a rotating device designed as an auxiliary conveying device 18. As best seem in FIG. 6, the conveying device 1 has in the rotation region a rising section 16 and a falling section 17. The sections 16 and 17 are subdivided into portions 16*a*, 16*b* and 17*a*, 17*b*. Of the auxiliary conveying device 18, there is shown schematically a conveying means 19, for example a chain, circulating in the direction of the arrow C, on which gripper means are fitted at regular intervals. The auxiliary conveying device 18 has a falling section 20*a* and an adjacent rising section 20*b* in the region that is effective as a conveyor. In the returning region, the auxiliary conveying device 18 is subdivided into a falling section 20*c* and an adjacent rising section 20*d*.

Figure 7:
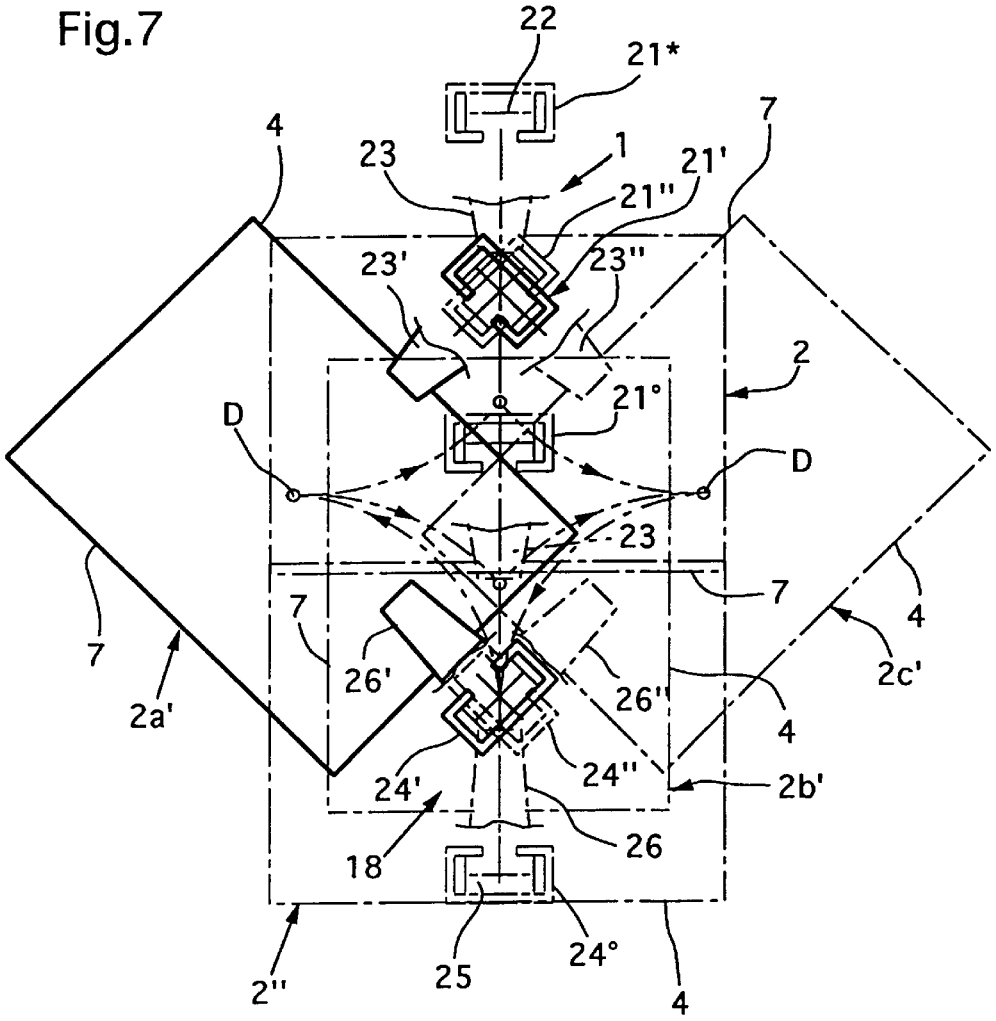
FIGS. 6–8 show a first embodiment of a device for rotating printed products, as well as the sequence of the rotation operation.

As best seen in FIG. 7, in which the various phases of the rotational motion of a printed product are shown, the conveying device 1 has a guide rail 21 with a C-shaped cross section, in which a conveying means 22, for example a link chain, is guided. Controllable grippers 23 for holding the printed products are fastened at regular intervals on this conveying means 22. Upstream and downstream of the rotation region 5, the guide channel 21 assumes a horizontally running position, which is designated by 21° in FIGS. 7 and 8*a* and 8*f*. Along the portion 16*a* of the rising section 16 (FIG. 6), the guide rail 21 is twisted through 45°. The position of the guide rail 21 at the end of the portion 16*a* is illustrated in FIGS. 7 and 8*b*. In this position, the guide rail is designated by 21'. Along the adjoining portion 16*b*, the guide rail is rotated back through 45°, with the result that the guide rail assumes the original spatial position at the highest point 16' of the rising section 16 (FIG. 6). In FIGS. 7, 8*c* and 8*d*, the guide rail is designated by 21* at this highest point 16'. Along the first portion 17*a* of the falling section 17 (FIG. 6), the guide rail 21 is rotated once more, likewise through 45°, in the same direction of rotation as the preceding rotation back, that is to say in the counterclockwise direction in the illustration of FIGS. 7 and 8. At the end of the portion 17*a*, the guide rail assumes the position shown in FIGS. 7 and 8*e* and designated by 21". Along the adjoining portion 17*b*, the guide rail 21 is rotated back, once more through 45°, into the normal position designated by 21° (see FIGS. 7 and 8*f*). As a result of this rotation of the guide rail 21, the grippers 23 are also correspondingly rotated during their movement along the sections 16 and 17. The individual rotational positions of the grippers are designated by 23, 23' and 23" in FIGS. 7 and 8*b*–8*e*.

As best seen in FIGS. 7 and 8, the auxiliary conveying device 18 likewise has a guide channel 24 of C-shaped cross section, in which a conveying means 25, for example a chain, is guided. Grippers 26 are fastened at regular intervals on this conveying means 25. The guide channel 24 is arranged underneath the guide rail 21 of the conveying device 1 in such a way that the grippers 26 are directed upward, that is to say toward the grippers 23 of the conveying device 1. A twisting of the guide channel 24, corresponding to the twisting of the guide channel 21 of the conveying device 1, takes place in the sections 20*a*–20*d*. At the beginning of the section 20*a*, the guide rail designated by 24' in FIGS. 7 and 8*b* is rotated through 45° with respect to the vertical. Along the section 20*a*, the guide rail 24 is rotated back once more into the normal position, which it reaches at the lowest point, designated by 18' in FIG. 6, and which is designated by 24° in FIGS. 7 and 8*c*. A further twisting of the guide rail 24 through 45° in the same direction of rotation is subsequently performed along the portion 20*b*. The corresponding final position of the guide rail is designated by 24" in FIGS. 7 and 8*e*.

A rotation back of the guide rail 24 then takes place, to be specific through 45°, along the section 20*c* and subsequently through 45° once more in the same direction of rotation along the section 20*d*, so that the guide rail once more assumes the position designated by 24' in FIGS. 7 and 8*b* at the beginning of the section 20*a*. The grippers 26 are subjected to a corresponding rotational movement. The various positions of the grippers 26 are designated by 26', 26 and 26" in FIGS. 7, 8*b*–8*e*.

During this course of the guide rails 21 and 24 of the conveying device 1 and, respectively, the auxiliary conveying device 18, the following sequence results of the rotational movement of the printed products 2, which is now to be explained using FIGS. 6 and 7 and FIGS. 8*a*–8*d*.

Figure 8A:
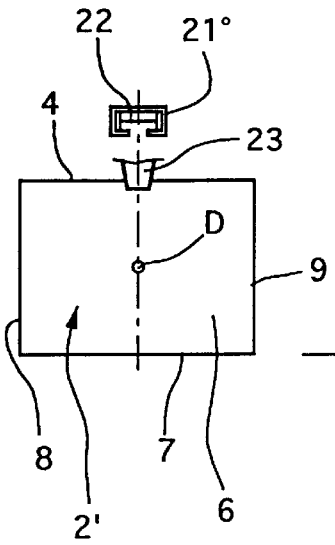
Figure 8B:
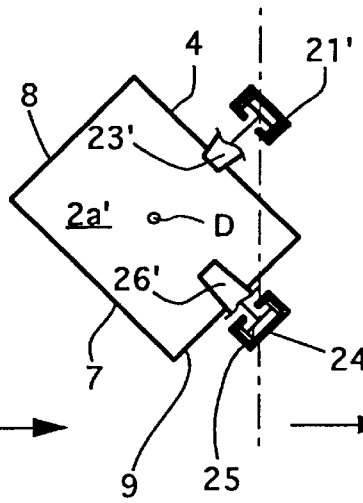
Figure 8C:
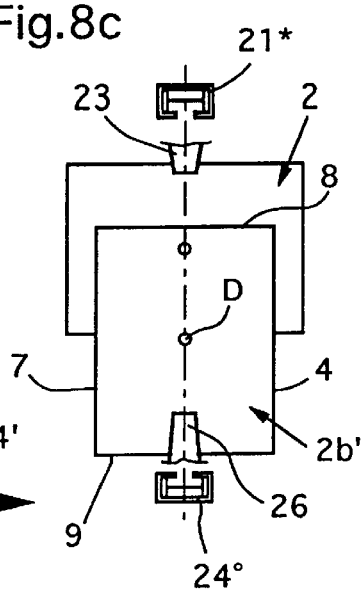
Figure 8D:
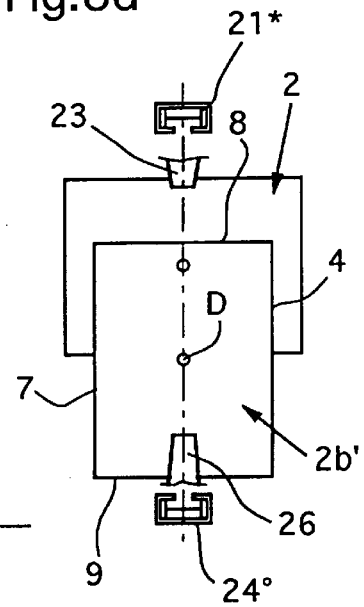

The printed products 2, 2' are conveyed by the conveying device 1 in a hanging position and at the same time are held by the grippers 23 of the conveying device 1 at the side edge designated by 4, as is illustrated on the left-hand side of FIG. 6 and in FIG. 8*a*. During the passage through the portion 16*a* of the rising section 16, a rotation of the grippers 23 through 45° is performed, together with the printed products 2, 2' held by said grippers. At the end of the portion 16*a*, the printed products assume a position designated by 2*a*' in FIGS. 7 and 8*b*. In this position, the printed products 2' to be rotated are now gripped at the side edge 9 by the grippers, designated by 26', of the auxiliary conveying device 18. At the same time, the products 2*a*' are released by the grippers 23'. During the subsequent movement of the grippers 26' along the section 20*a*, a rotation of the printed products through 45° is performed into the position designated by 2*b*' in FIGS. 7, 8*c* and 8*d*. During the further movement along the section 20*b*, the printed products 2*b*' are rotated further in the same direction, until at the end of the section 20*b* they assume the position designated by 2*c*' in FIGS. 7 and 8e. The printed products 2*c*' are now taken over once more by the associated gripper of the conveying device 1, which at this point, namely at the end of the portion 17*a* of the falling section 17 of the conveying device 1, assumes a position that is rotated through 45° with respect to the vertical. In this position, shown in FIGS. 7 and 8*e*, the gripper is designated by 23". This gripper 23" grips the printed product 2*c*" at the side edge 7, which is located opposite the side edge 4, at which the printed products 2' were originally held by the grippers 23. The grippers 26" can now release the printed products 2*c*'. During the subsequent passage through the sections 20*c* and 20*d*, the grippers 26, as described, are rotated back once more into the position shown in FIG. 8*b*. During the movement along the portion 17*b* of the falling section 17, the grippers 23" are rotated back through 45° into the normal position shown in FIG. 8*f* and designated by 23. The rotated printed product 2" is now conveyed further, together with the nonrotated printed products 2, in a hanging position, as is shown on the right-hand side of FIG. 6.

From the illustrations of FIGS. 7 and 8, it can readily be seen that a rotation of the printed products 2' through 180° is performed about an axis of rotation which runs at right angles to the main surface 6 of the printed products 2'. In FIGS. 7 and 8, the point of intersection of this axis of rotation with the printed products 2' is designated by D.

The printed products 2 that are not to be rotated remain held by the grippers 23 during the passage through the rising section 16 and the falling section 17, but in so doing are pivoted sideways, just like the printed products 2' to be rotated, corresponding to the course of the guide rail 21.

Figure 8E:
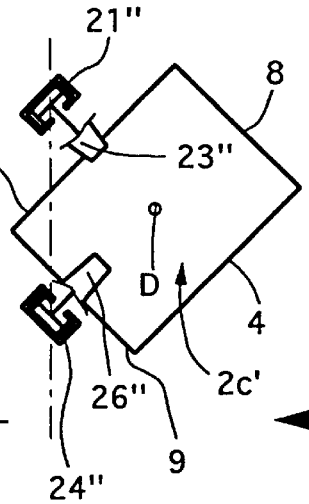
Figure 8F:
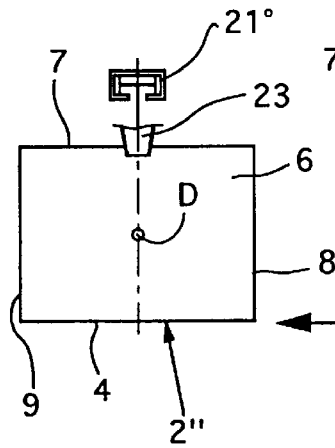

By virtue of the fact that, in the rotation region 5, the conveying device 1 has a rising section 16 and the auxiliary conveying device 18 has a falling section 20*a* located underneath the latter, space is created in order to rotate the products 2'. In this connection, reference is made to the illustration of FIGS. 8*c* and 8*d*. The conveying device 1 and the auxiliary conveying device 18 must subsequently be brought together once more to such an extent that renewed gripping of the rotated printed products 2" by the grippers 23 can be performed (FIG. 8*e*). This is achieved by providing a falling section 17 of the conveying device 1 and a rising section 20*b* of the auxiliary conveying device 18.

It goes without saying that the auxiliary conveying device 18 must be arranged in relation to the conveying device 1 in such a way that the grippers 23 and the grippers 26 at the end of the portion 16*a* of the rising section 16 and, respectively, at the beginning of the section 20*a*, as well as at the end of the portion 17*a* of the falling section 17 and, respectively, at the end of the section 20*b* meet, in order to enable transfer of the printed products 2' to be rotated and of the rotated printed products 2".

A second embodiment of a device for rotating specific printed products will be described using FIGS. 9–11, the same reference symbols being used for mutually corresponding parts as in the preceding FIGS. 1–8.

The conveying device 1, like the conveying device 1 according to FIGS. 6 and 7, has grippers 23 which are fastened on a conveying means 22. The gripper jaws of the grippers 23 are in this case designated by 23*a* and 23*b*. The conveying device 1 has a rising section designated by 27. Arranged upstream of the rotation region 5 is a triggering apparatus 28, which serves to open specific grippers 23. Downstream of the section 27, viewed in the conveying direction A, there is provided a closing device 29 with a control surface 29*a*, which serves to close the grippers 23. The conveying device 1 may be designed for example as described in EP-A-0 557 680 or EP-A-0 600 183 and the corresponding U.S. Pat. Nos. 5,388,820 and 5,395,151 respectfully. Provided underneath the conveying device 1 and to the side of the movement path of the printed products 2" are two mutually opposite auxiliary conveying devices 30, 31, of which only the auxiliary conveying device 30 is visible in FIG. 9. It can be seen from the illustration of FIG. 10 that, viewed in the conveying direction A of the printed products 2, 2', at the beginning the auxiliary conveying device 30 lies on the right-hand side and auxiliary conveying device 31 lies on the left-hand side of the movement path of the printed products 2, 2'.

The two auxiliary conveying devices 30, 31, like the conveying device 1, have a guide rail 32 and 33, respectively, of C-shaped cross section, in which a conveying means 34 and 35 is guided. Grippers 36 and 37 are fastened at regular intervals on these conveying means 34, 35, which is preferably are chains. The guide rails 32 and 33 are arranged such that the grippers 36 and 37 are directed towards one another, as best seen in FIGS. 10 and 11. The movement path of the grippers 36, 37 is closed and has a rising section 38. The guide rails 32, 33 are guided in such a way that they cross over in the rotation region 5, see FIG. 9, and subsequently come to lie on the respectively opposite side of the movement path of the printed products 2, 2'. This can also be seen by comparing FIG. 11 with FIG. 10. As revealed in FIG. 11, after this crossover, the auxiliary conveying device 30 is on the left-hand side, viewed in the conveying direction A or E, and the other auxiliary conveying device 31 is on the right-hand side of the movement path of the printed products. In the subsequent return region of the auxiliary conveying device 30, 31, a corresponding crossover of the guide rails 32, 33 is performed, in order that the conveying devices 30, 31 once more have the mutual arrangement shown in FIG. 10.

Figure 9:
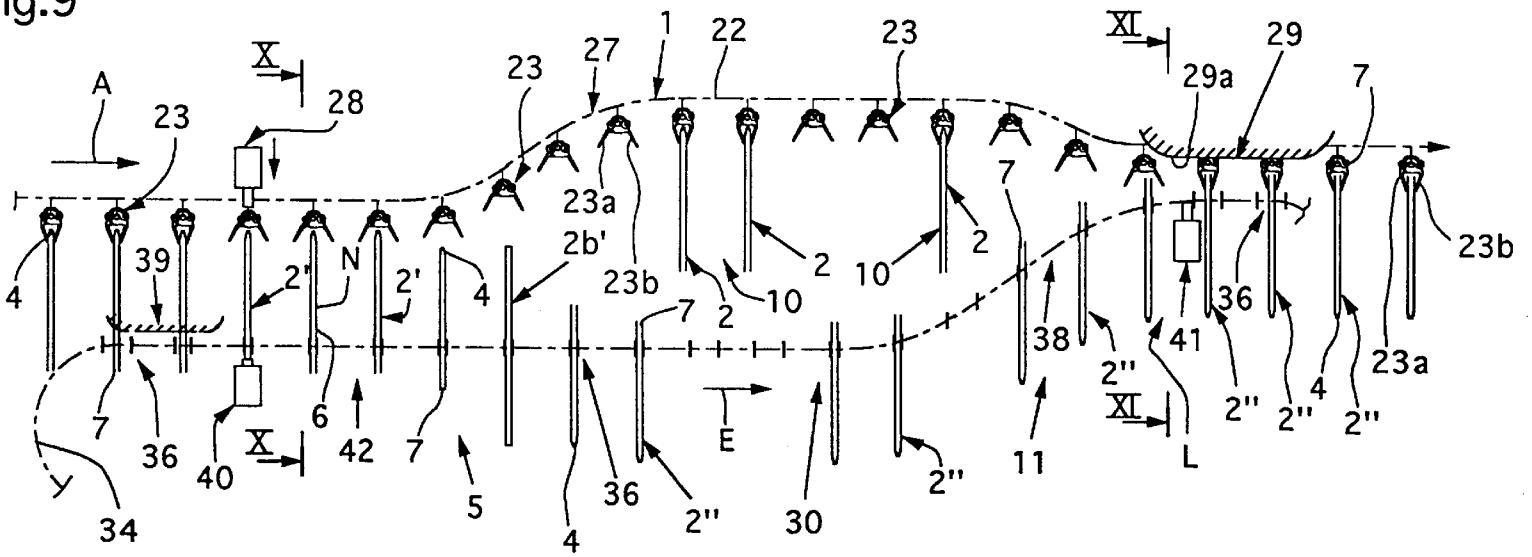
FIG. 9 shows a second embodiment of a device for rotating printed products.

As shown in FIG. 9, at the beginning of the conveying portion of the auxiliary conveying devices 30, 31, there is in each case a closing device 39, which serves to close the grippers 36 and 37. Arranged directly downstream of this closing device 39 is a first triggering apparatus 40, and at the end of the effective conveying portion a second triggering apparatus 41. These triggering apparatuses 40, 41 serve to open the grippers 36 and 37.

Figure 11:
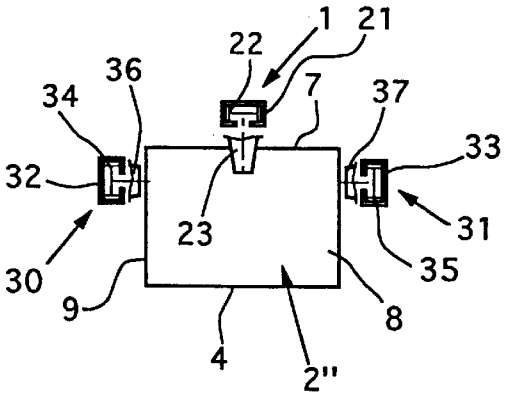
FIG. 11 shows a section view taken along the line XI—XI in FIG. 9.
Figure 10:
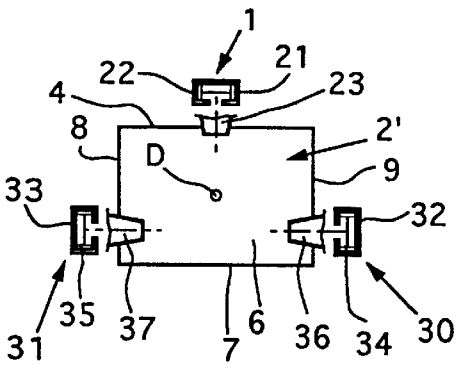
FIG. 10 shows a section view taken along the line X—X in FIG. 9.

The method of operation of the device according to FIGS. 9–11 is as follows:

The printed products 2, 2' are guided to the rotation region 5, held in the region of their side edges 4 by the grippers 23 (left-hand side of FIG. 9). In the region of the closing device 39, all the printed products 2, 2' are gripped at their side edges 8 and 9 by the grippers 36 and 37 of the auxiliary conveying devices 30, 31 (FIG. 10). The closing of the open grippers 36, 37 is performed by means of the closing device 39. As the grippers 23 then run past the triggering apparatus 28, and the grippers 36, 37 run past the opposite triggering apparatus 40, in each case either the gripper 23 or the grippers 36 and 37 are opened. The printed products 2, which continue to be held by the grippers 23, are conveyed further through the conveying device 1. The sections comprising one or more nonrotated printed products 2 are designated by 10 in FIG. 9, as in the preceding figures.

Those printed products 2' which are intended to be rotated are released by the grippers 23 and, for the further movement in the direction of the arrow E, are held by the grippers 36 and 37 of the auxiliary conveying devices 30 and 31. Since, as already described, the auxiliary conveying devices 30 and 31 change sides as a result of their guide rails 32, 33 crossing over, the printed products 2' are rotated while passing through the rotation region 5. This rotation is about an axis of rotation N which extends at a right angles to the main surface 6 of the printed products 2'. The point at which this axis of rotation N passes through the said main surface 6 is likewise designated by D in FIG. 10. In FIG. 9, **2*b*' shows a printed product during rotation in a position which corresponds to the intermediate position shown in FIGS. 8*c* and 8*d*. The printed products that are rotated through 180° and designated by 2" are conveyed along the rising section 38 toward the conveying device 1. In a transfer region L, the rotated printed products 2" are brought together with open grippers 23 of the conveying device 1, the printed products 2" being gripped in the region of the side edge designated 7. By means of the closing device 29, the grippers 23 are closed, while the triggering apparatus 41 opens the grippers 36, 37 of the auxiliary conveying devices 30 and 31. Downstream of the transfer region L, the nonrotated and rotated printed products 2 and 2"**, respectively, are conveyed further section by section.

It should be noted that the auxiliary conveying devices 30, 31 thus have to be matched to the conveying device 1 in order that correct transfer of the printed products 2' and 2" can be performed. By virtue of the fact that the conveying device 1 has a rising section 27, space is created for the rotation of the printed products 2'.

Figure 12:
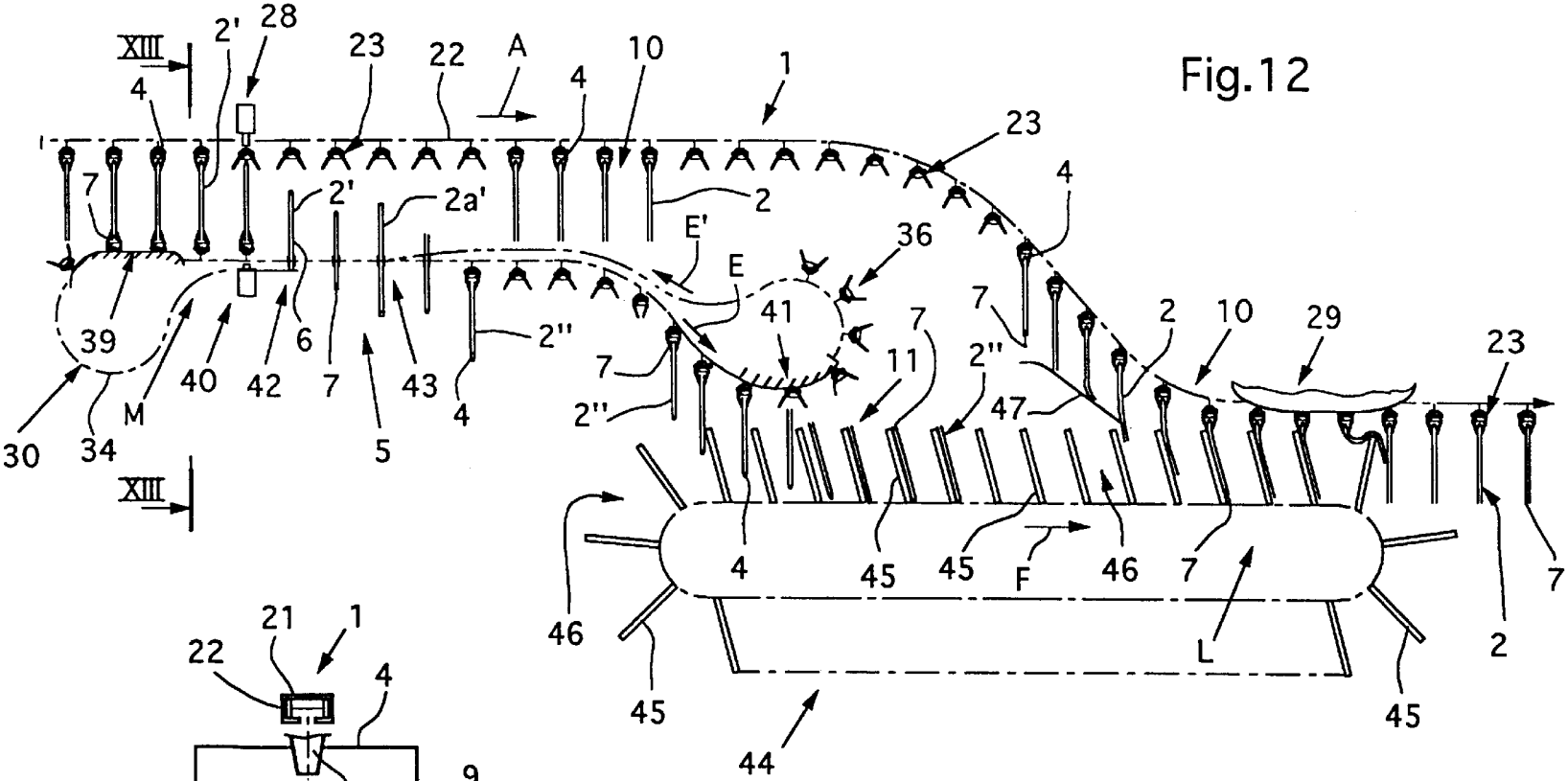
FIG. 12 shows a third embodiment of a device for rotating printed products.
Figure 13:
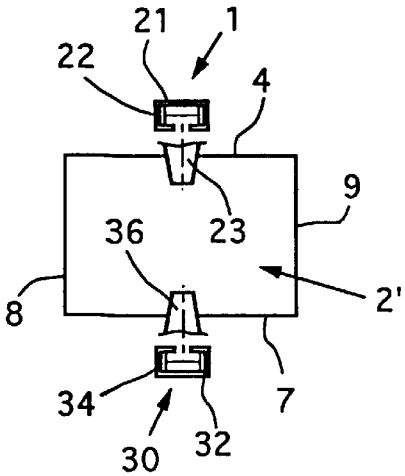
FIG. 13 shows a section view taken along the line XIII—XIII in FIG. 12.

A further, third embodiment of a device for rotating specific printed products is shown in FIGS. 12 and 13, said device having a certain similarity to the embodiment according to FIGS. 9–11, but having only one auxiliary conveying device 30 instead of two auxiliary conveying devices. In FIGS. 12 and 13, the same reference symbols are used for mutually corresponding components as in FIGS. 9–11.

The single auxiliary conveying device 30 is arranged underneath the conveying device 1. In the transfer region M, in which the auxiliary conveying device 30 takes over the sections 42 with printed products 2' to be rotated from the conveying device 1, the guide rail 32 of the auxiliary conveying device 30 lies opposite the guide rail 21 of the conveying device 1 (see FIG. 13) and is aligned in such a way that the grippers 36 face the grippers 23. Adjoining this transfer region M is a twisting portion 43, which extends through the rotation region 5 and along which the guide rail 32 is rotated through 180° in its longitudinal direction, with the result that the originally upwardly directed grippers 36 are directed downward, as is visible from FIG. 12. The triggering apparatus 41 arranged at the end of the effective conveying portion of the auxiliary conveying device 30 is constructed as a control cam to open the grippers 36.

Arranged underneath the auxiliary conveying device 30 and thus also underneath the conveying device 1 is a transporting device 44, which has a number of supporting walls 45 arranged one behind another in the circulation direction F. Supporting walls 45 are inclined rearward, viewed in the circulation direction F. Compartments 46 are formed between adjacent supporting walls 45 to receive the rotated printed products 2". The transporting device 44 takes over the rotated printed products 2" from the auxiliary conveying device 30 and takes the printed products 2" into the transfer region L, in which the printed products 2" are taken over once more by the grippers 23 of the conveying device 1.

The method of operation of the device according to FIGS. 12 and 13 is as follows:

The conveying device 1 takes the printed products 2, 2' in a hanging position to the transfer region M, the printed products being held at their side edge 4 by the grippers 23. In the region of the closing device 39, the printed products are gripped at the opposite side edge 7 by the grippers 36 of the auxiliary conveying device 30. The grippers 36 are closed by the closing device 39. This means that the printed products are briefly held both by a gripper 23 and by a gripper 36, as FIG. 13 shows. For those printed products which are not intended to be rotated, the grippers 36 of the auxiliary conveying device 30 are opened once more by the triggering apparatus 40, with the result that these printed products 2 can be conveyed further by the conveying device 1 in an unimpeded manner. By contrast, for the printed products 2' to be rotated, the gripper 23 of the conveying device 1 is opened by the triggering apparatus 28. These printed products 2' are transported further by the auxiliary conveying device 30, the printed products 2' being rotated through 180° about an axis of rotation running at right angles to their main surface 6 whilst passing through the twisting portion 43, and being brought into a hanging position. The rotated printed products 2' are then individually in each case inserted into a compartment 46 of the transporting device 44, and released by the grippers 36 of the auxiliary conveying device 30 that are opened by the triggering apparatus 41. The grippers 36 run back along the return portion of the auxiliary conveying device 30 in the direction of the arrow E', the guide rail 32 of the auxiliary conveying device 30 once more being rotated back through 180° in the region of this return portion, in order that the grippers 36 are brought once more into the correct position to take over a new printed product.

The rotated printed products 2" that are conveyed by the transporting device 44 into the transfer region L are taken over in this transfer region L by the open grippers 23 of the conveying device 1. The closing of the grippers 23 is performed by the closing device 29. Downstream of the transfer region L, the conveying device 1 thus conveys sections 10 of nonrotated printed products 2 and sections 11 of rotated printed products 2".

As FIG. 12 shows, arranged upstream of the transfer region L is a guide rail 47, on which the printed products 2 come to rest in the region of their side edge 7 located at the bottom. This guide rail 47 ensures that the nonrotated printed products 2 are also in each case inserted individually into a compartment 46 of the transporting device 44. However, the conveying of the nonrotated printed products 2 continues to be performed by the conveying device 1, whose grippers 23 remain closed, while the printed products 2 engage in the compartments 46.

Figure 14:
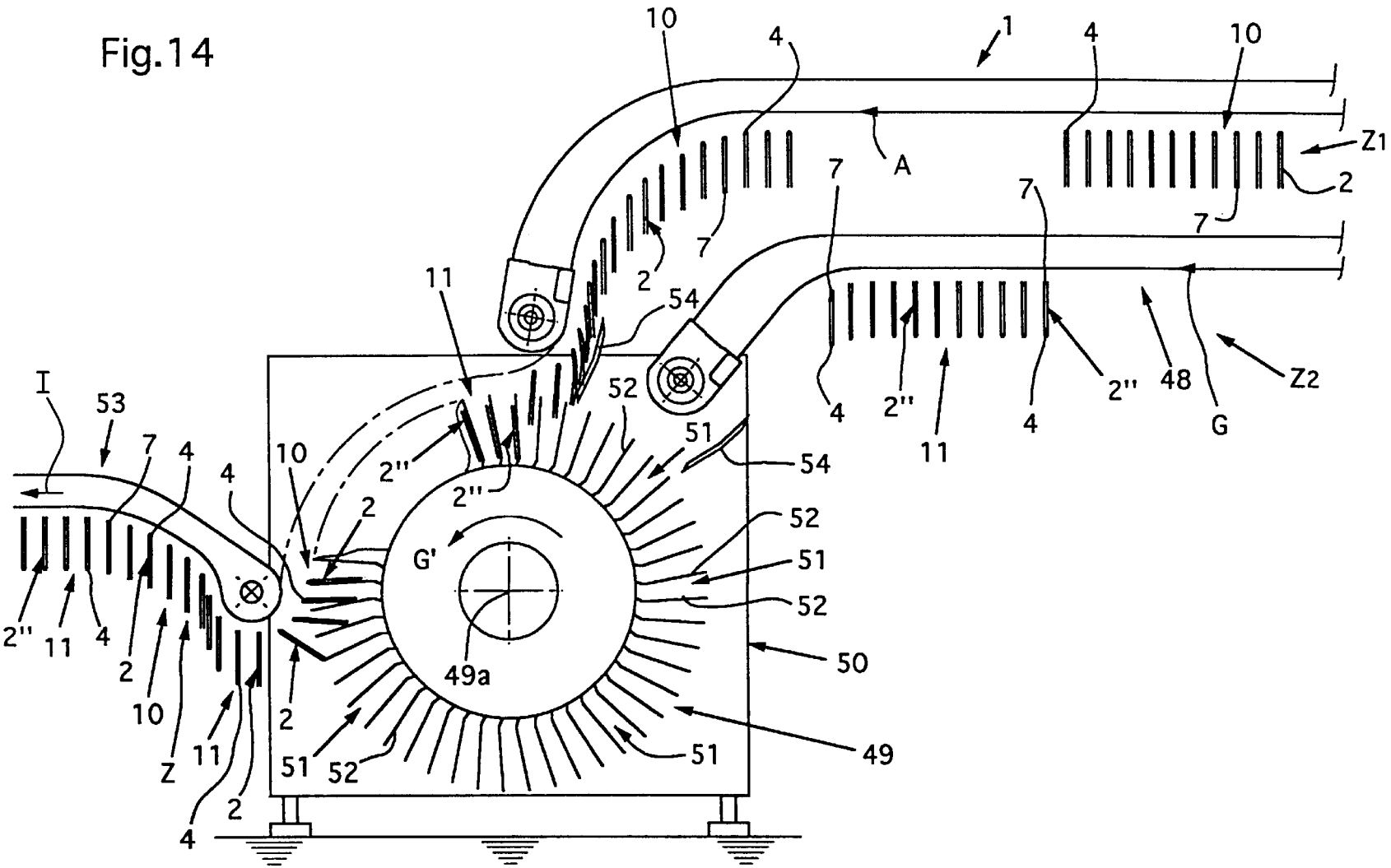
FIG. 14 shows a fourth embodiment of a device for rotating printed products.

FIG. 14 shows a device for processing rotated and nonrotated printed products 2", 2, that is to say for the bringing together of two branch streams $Z_1$ and $Z_2$. In this case, the branch stream $Z_1$ is formed by sections 10 with nonrotated printed products 2, and the branch stream $Z_2$ is formed by sections 11 of rotated printed products 2". The printed products 2 of the branch stream $Z_1$ are fed by the conveying device 1. Between the individual sections 10 there are gaps which are produced by virtue of the fact that, as a precursor to the continuous product stream, the printed products 2' to be rotated have been removed.

The device shown in FIG. 14 has a second conveying device 48 with a conveying direction G. This conveying device 48 brings the rotated printed products 2", section by section, from a rotation region in which specific printed products have been rotated in a manner not shown in FIG. 14. For example, the printed products 2' to be rotated can be rotated, as explained using FIGS. 12 and 13, with the aid of an auxiliary conveying device, which is designated by 48 in FIG. 14. In the branch stream $Z_2$ conveyed by the auxiliary conveying device 48, the sections 11 with rotated printed products 2" are likewise separated from each other by spaces. These spaces then correspond to the lengths of the sections 10 with nonrotated printed products 2.

Connected downstream of the two conveying devices 1 and 48 is a receiving drum 49, which is mounted in a frame 50 so that it can rotate in the direction of the arrow G' about a horizontal axis of rotation 49*a*. This receiving drum 49 has radially extending compartments 51, open at the circumference, which are separated from one another by dividing walls 52. Arranged downstream of this receiving drum 49 is a delivery conveyor 53 with a conveying direction 1. The delivery conveyor 53, like the conveying devices 1 and 48, has grippers which grip the printed products at one side edge 4 or 7. At the delivery end of the conveying devices 1 and 48 there are arranged sheet-metal guides 54 which are used for the purpose of steering the printed products 2 and 2" into the compartments 51 of the receiving drum 49.

The illustration of FIG. 14 permits the method of operation of the device shown to be readily recognised. Both the nonrotated printed products 2 conveyed by the conveying device 1, and the rotated printed products 2", which are brought up by the second conveying device 48, are inserted individually and one after another into the compartments 51 of the receiving drum 49. The products 2 and 2" are inserted into the compartments 51 with their edge 4 and 7 located at the bottom, in front. In the receiving drum 49, the two branch streams $Z_1$ and $Z_2$ are thus once more combined into one product stream. The printed products 2, 2" are gripped at their radially outer side edge 4 or 7 by the grippers of the delivery conveyor 53, and conveyed out of the compartments 51 of the receiving drum 49 and away in the conveying direction I of the delivery conveyor 53. In the product stream Z conveyed by the delivery conveyor 53, sections 10 with nonrotated printed products 2 alternate with sections 11 with rotated printed products 2", as shown in FIG. 4.

Instead of one delivery conveyor 53 that is independent of the conveying device 1, as shown, it is also conceivable to design this delivery conveyor 53 as part of the conveying device 1. In the case of such an embodiment, the conveying device 1 would accordingly grip the printed products 2, 2" once more after their insertion into the compartments 51 of the receiving drum 49, and draw them out of the compartments 51, in a manner similar to that explained with reference to FIG. 12. In this case, it would also be possible for the grippers of the conveying device 1 to keep the nonrotated printed products 2 held by them gripped during the engagement of these printed products 2 into the compartments 51, which primarily provides advantages when the printed products are of many parts, that is to say comprise parts loosely laid inside one another.

Two exemplary embodiments for the further processing of product streams Z, which comprise alternating sections 10 with nonrotated printed products 2 and sections 11 with rotated printed products 2", will now be described using FIGS. 15 and 16.

Figure 15:
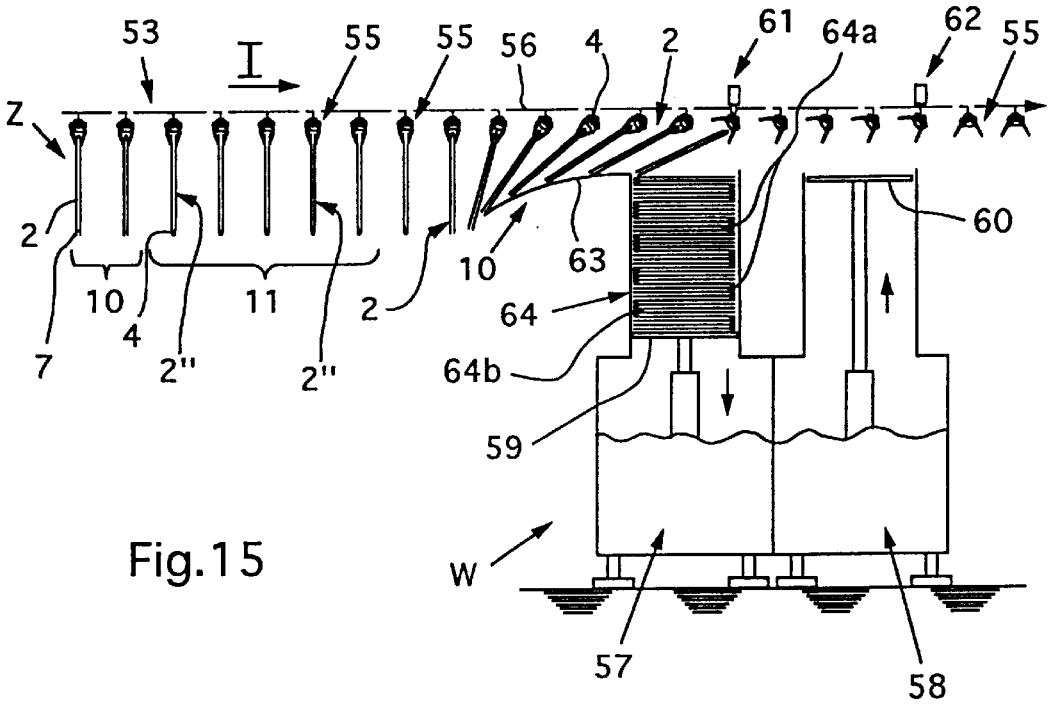
FIGS. 15 and 16 show two examples of possible further-processing types of product streams with printed products mutually rotated section by section.

In the case of the embodiment according to FIG. 15, such a product stream Z is transported by means of a conveyor, which may for example be the delivery conveyor 53 of FIG. 14 or else the conveying device 1 according to FIG. 9 or 12, to a further processing point W. The conveyor 53 likewise has controlled grippers 55, which are fastened at mutual intervals on a conveying means 56 (for example a chain). The conveying of the printed products 2, 2" is in this case performed in a vertical hanging position.

At the further processing point W there are two stacking stations 57 and 58, which are arranged one behind another in the conveying direction I of the conveyor 53. Each stacking station 57, 58, which is of known construction, has a supporting table 59 and 60, which can be raised and lowered in the vertical direction. Arranged in the region of each stacking station 57, 58 is a triggering apparatus 61 and 62, which serves to open the grippers 55. Preceding the first stacking station 57 is a sheet-metal guide 63, on which the printed products 2, 2" come to rest in the region of their side edge 4 or 7, located at the bottom, and which serves to bring the printed products 2, 2", as shown, out of their vertical hanging position into an oblique position.

The printed products 2, 2" brought up are deposited in a known manner either on the stacking table 59 or the stacking table 60, depending on whether the grippers 55 are opened by the triggering apparatus 61 or the triggering apparatus 62. On the supporting table 59 or 60, stacks 64 are formed which comprise part stacks 64*a* and 64*b*. The part stacks 64*a* comprise the nonrotated printed products 2, whereas the part stacks 64*b* comprise the rotated printed products 2". As a result of the preceding rotation, of specific printed products, such a crossed layer of the part stacks 64*a* and 64*b* results quite naturally, without any rotation of the supporting table 59 or 60 being necessary. The construction of the stacking stations 57, 58 can thus be simplified. The finished stack 64, comprising crossed layers 64*a*, 64*b*, can be formed without intermediate operations and hence without interruptions. As soon as a stack 64 is finished in the stacking station 57, the triggering apparatuses 61, 62 are switched over, with the result that the printed products 2, 2" are then deposited on the supporting table 60 of the other stacking station 58. The finished stack 64 can then be ejected, for example directly into a wrapping station, in which the stack 64 is taped or wrapped with a film.

Figure 16:
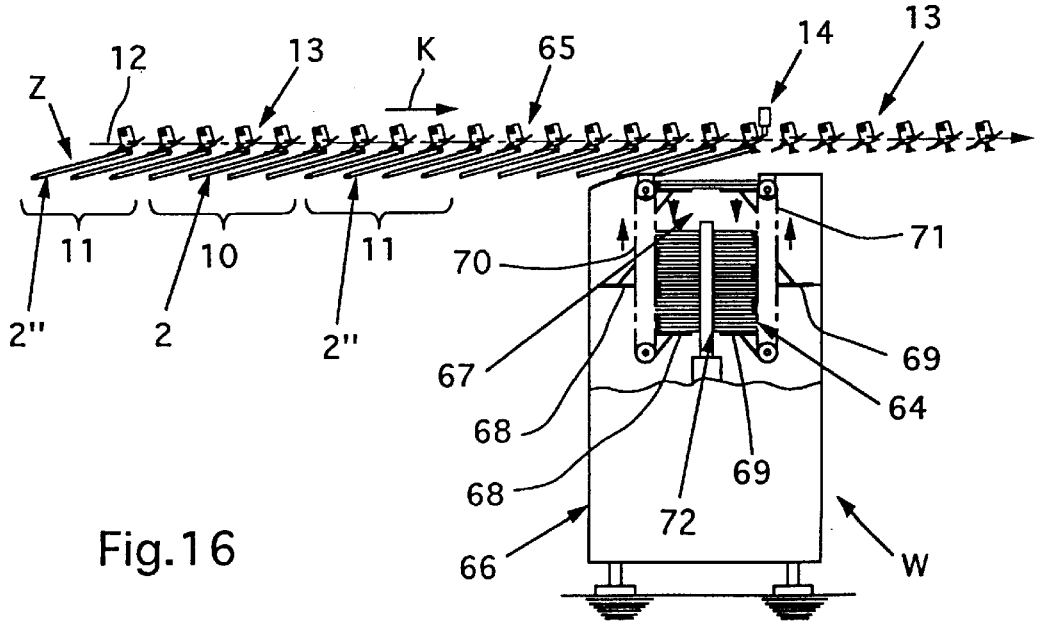

The embodiment according to FIG. 16 differs from the embodiment shown in FIG. 15 through a different design of the feed conveyor and the stacking device at the further processing point. The feed conveyor 65 shown in FIG. 16 corresponds to the conveying device 1 shown in FIG. 5 and likewise has grippers 13 which are fastened on a pulling means 12. The feed conveyor 65 conveys the printed products 2, 2" in a hanging position falling obliquely rearward to the further processing point W. In the product stream Z conveyed by the feed conveyor 65, the sections 10 with nonrotated printed products 2 and the sections 11 with rotated printed products 2" alternate.

Arranged at the further processing point W is a single stacking station 66, above which there is arranged a triggering apparatus 14 to open the grippers 13. This stacking station 66 has, instead of a single supporting table that can be raised and lowered, supporting elements 68 and 69, which are fastened at intervals to circulating conveying means 70 and 71, which are arranged on either side of the stacking space 67. In this case, the supporting elements 68, 69 are arranged in such a way that in each case one supporting means 68 and one supporting means 69 together form a support for the printed products 2, 2". As soon as a stack 64 which, as described using FIG. 15, comprises cross-laid part stacks 64*a* and 64*b*, is finished, it is ejected from the stacking space 67 by an ejecting member 72. While one stack 64 is being ejected, it is already possible to begin forming the next stack, which is supported by the following pair of supporting elements 68, 69.

Instead of conveying the printed products to the further processing point W by means of conveyors 53 and 65 having grippers 55 and 13, as shown in FIGS. 15 and 16, it is also conceivable to feed the product stream Z, as shown in FIG. 5, by means of a belt conveyor.

Apart from stacking, nonrotated and rotated printed products 2, 2", as described using FIGS. 15 and 16 which is possible in a simplified manner thanks to the preceding rotation of specific printed products 2' during their conveying, various other applications in further processing are also conceivable. As a result of the subdivision of the product stream into sections with rotated and nonrotated printed products, advantages are obtained.

What is claimed is:

1. A method for processing flat printed products, comprising the steps of: holding the flat printed products along a first side edge by associated controllable grippers, conveying the flat printed products held by said associated controlled grippers along a first conveying path and in a product stream, releasing and rotating at least some of the flat printed products through at least 90° about an axis of rotation situated at right angles to their main surface, and following the rotation gripping the printed products once more on another side edge by an associated controllable gripper for further transport.

2. The method as claimed in claim 1, wherein the printed products are conveyed with the gripped side edge located at the top, in a hanging position, preferably in an approximately vertical hanging position.

3. The method as claimed in claim 1, wherein the printed products are conveyed with the first side edge running transversely, to the conveying direction.

4. The method as claimed in claim 1, wherein the rotation of the printed products is through 180°.

5. The method as claimed in claim 1, wherein two or more printed products are held by the same gripper and the rotation of the printed products held by the same gripper is performed simultaneously.

6. The method as claimed in claim 1, wherein the printed products that have been gripped once more on another side by an associated controllable gripper for further transport are now in a product stream in which sections with non-rotated printed products alternate with sections with rotated printed products.

7. The method as claimed in claim 6, wherein, alternately, a number of successive printed products are rotated and a number of successive printed products are not rotated.

8. The method as claimed in claim 6, wherein the printed products in the product stream formed following the rotation and gripping of the printed products once more on another side edge by an associated controllable gripper are fed to a further processing point at which the printed products are preferably stacked.

9. An apparatus for processing flat printed products, having a first conveying device for conveying the printed products along a first conveying path, which first conveying device has associated controllable grippers, arranged one behind another at intervals in the conveying direction, to grip the printed products in the region of a first side edge, wherein there is arranged below the first conveying device a transporting and rotating apparatus which grips at least some of the printed products conveyed by the first conveying device in the region of at least one second side edge, said at least one second side edge runs parallel or at right angles to said first side edge, said transporting and rotating apparatus transports the gripped printed products in a direction of motion that runs in the conveying direction of the first conveying device and, at the same time, on its own or in cooperation with the first conveying device, said transporting and rotating apparatus rotates said printed products through at least 90° about an axis of rotation situated at right angles to their main surface.

10. The apparatus as claimed in claim 9, wherein the transporting and rotating apparatus has associated controllable grippers, arranged one behind another at intervals in its conveying direction, which grip the printed products to be rotated at the at least one second side edge and, during their movement in the conveying direction, can be pivoted through at least 90° about an axis running in said conveying direction.

11. The apparatus as claimed in claim 10, wherein the transporting and rotating apparatus has an auxiliary conveying device whose grippers grip on a second side edge, which runs parallel to said first side edge.

12. The apparatus as claimed in claim 10, wherein the transporting and rotating apparatus has two mutually opposite auxiliary conveying devices which are arranged to the side of the movement path of the printed products to be rotated and whose grippers are directed toward one another and, during their movement in the conveying direction, can be pivoted through 180°, the grippers of the two auxiliary conveying devices gripping the printed products to be rotated at two mutually opposite side edges, which run at right angles to said first side edge.

13. The apparatus as claimed in claim 9, wherein there is arranged downstream of the transporting and rotating apparatus a transporting device which has upwardly open compartments that are driven in circulation, are arranged one behind another and serve to accommodate the rotated printed products released by the transporting and rotating apparatus, and wherein, a delivery conveyor is provided to convey away the printed products removed from said compartments.

14. The apparatus as claimed in claim 9, which comprises a second conveying device for conveying said rotated printed products in sections spaced apart from one another, a receiving drum which can be driven in rotation and is arranged downstream of said second conveying device, said receiving drum has radial receiving compartments, open at the circumference of said receiving drum, which serve to accommodate both the rotated printed products and the non-rotated printed products which are fed by the first conveying device in sections spaced apart from one another to the receiving drum, and a delivery conveyor to convey away the printed products removed from the receiving compartments.

15. The apparatus as claimed in claim 13, wherein the delivery conveyor is formed by said first conveying device.

16. The apparatus as claimed in claim 9, which includes a feed conveyor for feeding a product stream, said product stream including sections with non-rotated printed products alternate with sections with rotated printed products, said feed conveyor adapted to feed said product stream to a further processing point.

17. The apparatus as claimed in claim 16, wherein there are provided at said further processing point one or more stacking stations, in which stacks are formed from said product stream.

18. The apparatus as claimed in claim 14, wherein said delivery conveyor is formed by said first conveying device.

* * * * *